US009417572B2

(12) United States Patent
Hamilton et al.

(10) Patent No.: US 9,417,572 B2
(45) Date of Patent: Aug. 16, 2016

(54) FUSER HEATING ELEMENT FOR AN ELECTROPHOTOGRAPHIC IMAGING DEVICE

(75) Inventors: Douglas Campbell Hamilton, Lexington, KY (US); Jerry Wayne Smith, Irvine, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 12/971,679

(22) Filed: Dec. 17, 2010

(65) Prior Publication Data

US 2012/0155937 A1 Jun. 21, 2012

(51) Int. Cl.
*G03G 15/20* (2006.01)

(52) U.S. Cl.
CPC .... *G03G 15/2042* (2013.01); *G03G 2215/2035* (2013.01)

(58) Field of Classification Search
CPC ..... G03G 15/2057
USPC ..... 399/333
See application file for complete search history.

(56) References Cited

U.S. PATENT DOCUMENTS

| | | | | |
|---|---|---|---|---|
| 5,191,381 | A | 3/1993 | Yuan | |
| 5,499,087 | A * | 3/1996 | Hiraoka et al. | 399/329 |
| 5,660,750 | A * | 8/1997 | Kusaka | 219/216 |
| 6,090,313 | A * | 7/2000 | Zhao | 252/500 |
| 6,221,800 | B1 * | 4/2001 | Takahashi et al. | 501/137 |
| 6,462,643 | B1 * | 10/2002 | Fujii et al. | 338/22 SD |
| 6,580,883 | B2 | 6/2003 | Suzumi | |
| 6,826,382 | B2 | 11/2004 | Sanpei et al. | |
| 7,092,652 | B2 | 8/2006 | Matsumoto | |
| 2004/0126127 | A1 | 7/2004 | Fujimori et al. | |
| 2005/0008410 | A1 | 1/2005 | Arcaro et al. | |
| 2005/0145617 | A1 | 7/2005 | McMillin et al. | |
| 2005/0158063 | A1 | 7/2005 | Mizuno | |
| 2007/0230981 | A1 | 10/2007 | Cho | |
| 2008/0003027 | A1 | 1/2008 | Su | |
| 2008/0031648 | A1 * | 2/2008 | Iwasaki | G03G 15/657 399/68 |
| 2008/0124150 | A1 | 5/2008 | Schuman | |
| 2008/0135535 | A1 | 6/2008 | Brun et al. | |
| 2009/0263170 | A1 | 10/2009 | Kagawa et al. | |
| 2010/0303524 | A1 * | 12/2010 | Cao | G03G 15/2053 399/329 |
| 2011/0158691 | A1 * | 6/2011 | Foster | G03G 15/2053 399/122 |
| 2011/0299904 | A1 | 12/2011 | Oishi et al. | |
| 2012/0051766 | A1 | 3/2012 | Ueno et al. | |
| 2012/0070207 | A1 * | 3/2012 | Cao | G03G 15/2053 399/329 |

(Continued)

FOREIGN PATENT DOCUMENTS

| | | | | |
|---|---|---|---|---|
| JP | 07199697 A * | 8/1995 | | G03G 15/20 |
| JP | 2006012444 A * | 1/2006 | | |
| JP | 2008268729 A * | 11/2008 | | |

OTHER PUBLICATIONS

Machine translation of Kimura et al., JP 2006-012444.*

(Continued)

*Primary Examiner* — David Gray
*Assistant Examiner* — Sevan A Aydin

(57) ABSTRACT

A heating element for the fuser for an electrophotographic imaging device. The heating element includes a panel of positive temperature coefficient material having electrodes coupled to opposed surfaces thereof. The positive temperature coefficient material serves to stabilize the temperature of the heating element so as to prevent damage due to overheating.

23 Claims, 7 Drawing Sheets

(56) References Cited

U.S. PATENT DOCUMENTS

| | | | |
|---|---|---|---|
| 2012/0195658 | A1 | 8/2012 | Sakakibara et al. |
| 2015/0083706 | A1 | 3/2015 | Campbell et al. |
| 2015/0086232 | A1 | 3/2015 | Campbell et al. |

OTHER PUBLICATIONS

Machine translation of Hayakawa et al. (1995).*
Machine translation of Ito et al. (2008).*
Hsiao-Lin, Wang; Structure and Dielectric Properties of Perovskite-Barium Titanate ( $BaTiO_3$ ), San Jose State University, Dec. 2002, pp. 1-15.
Miclea et al, "Advanced Electroceramic Materials for Electrotechnical Applications," The Journal of Optoelectronics and Advanced Materials, vol. 4, No. 1, Mar. 2002, pp. 51-58.
Y. Chen et al., "Ni—$BaTiO_3$ Interface Phenomenon of Co—fired PTCR by Aqueous Tape Casting," Transactions of Nonferrous Metals Society of China, Sep. 2007, pp. 1391-1395.
International Search Report and Written Opinion for PCT Application PCT/US/65106, the International Searching Authority, Apr. 23, 2012.
Supplemental European Search Report for counterpart EP patent application EP11848597, European Patent Office, Apr. 14, 2014.
File History for U.S. Appl. No. 14/144,110, including non-final Office Action dated Oct. 2, 2015.
File History for U.S. Appl. No. 14/144,191, including Notice of Allowance dated Sep. 2, 2015.

* cited by examiner

FUSER HEATING ELEMENT FOR AN ELECTROPHOTOGRAPHIC IMAGING DEVICE

BACKGROUND

1. Technical Field

The present application relates generally to an electrophotographic imaging device and more particularly to a fuser for an electrophotographic imaging device.

2. Description of the Related Art

In the electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image and thereafter the toner image is transferred to the media intended to receive the image. The toner is fixed to the media by a combination of heat and pressure applied by a fuser.

The fuser may include a belt fuser that includes a fusing belt and an opposing backup member, such as a backup roll. The belt and the backup member form a nip therebetween. The media with the toner image is moved through the nip to fuse the toner to the media. Belt fusers allow for "instant-on" fusing where the fuser has a relatively short warm up time thereby reducing electricity consumption. Fusing speed is a function of the width of the fuser nip and the belt surface temperature, among other things. A fuser with a relatively wide nip is able to fuse toner to media moving at higher speeds through the nip than a comparable fuser with a relatively narrow nip. Further, a fuser with a higher belt surface temperature is able to fuse toner to the media faster than a fuser with a lower belt surface temperature. Higher fusing speeds in turn lead to higher print speeds.

Fusers in laser printers are designed to bond toner to the entire width of media by using heat and pressure. In most fusers, heat is generated by either by a halogen lamp or a ceramic heater. In the case of the halogen lamp fuser, heat is transferred radiantly from the lamp to the black coated inside of an aluminum tube. For monochrome printers, the aluminum tube may have a release layer of either a perfluoroalkoxy (PFA) or polytetrafluoroethylene (PTFE) coating. For color printers, the aluminum tube may be first coated with silicone rubber and then a perfluoroalkoxy (PFA) sleeve. In the cases of the fuser with ceramic heater, heat is transferred conductively from the ceramic heater to either a polyimide tube with a PFA and/or PTFE release layer (for a monochrome fuser), a stainless steel tube with a PFA and/or PTFE release layer (also a monochrome fuser), or a stainless steel tube with a silicone layer and a PFA sleeve (for a color fuser). The release layer coated surface of these tubes applies the heat to the surface of the media that has toner. The pressure is produced by a rubber coated steel or aluminum shaft that is pressed against the coated tube. The media passes between the coated tube and the rubber coated steel shaft. The rubber coated steel shaft typically has a PFA sleeve placed over the rubber coating. This rubber coated steel shaft is commonly called a backup roll. The length of the heating region is typically about 2 to 3 mm longer than the widest media that the laser printer is designed to print. An overheating problem occurs when narrow media is printed in the laser printer. In regions of the fuser nip where the media does not pass through the fuser, the tube and backup roll become very hot and may be damaged due to the high temperature.

In particular, in this case heat generated by the ceramic heater is not removed from those regions of the fuser nip which fail to contact media sheets passing through the nip. The heat generated in such regions heats the tube and the backup roll as a result. Because laser printers are designed to have a very small first copy time, the thermal mass of the heater and of the tube is very small. Because of the small thermal mass, the axial heat conduction from hot regions of the tube and heater to cooler regions is very small. This causes the amount of heat to build up relatively rapidly in the heater and tube in such fuser nip regions not contacting the passing media sheets. The heat build up is not significant for fuser nip regions contacting the media sheets because energy is removed from the system by the sheets and toner fixing. In addition, to achieve the very small first copy time and fix the toner to the media, the backup roll surface needs to become very hot without conducting heat to the steel or aluminum shaft. This is achieved because the rubber is a thermal insulator. However, this also means the heat conducted away from the coated tube and heater by the backup roll in regions not contacting the media sheets is very small.

One other possible mechanism to remove heat from the coated tube and backup roll in such overheating fuser nip regions is by convection into the air. Unfortunately, the amount of heat removed by convection is very small because in order to meet the very small first copy time, the heat lost to the air is minimized by enclosing the coated tube and backup roll in plastic covers to keep the air still. However, the plastic covers are designed to act as a heat insulating surface, thereby providing little if any opportunity to reduce heat to the overheating fuser nip regions via air convection.

A current solution to prevent overheating is to reduce the velocity of the media sheets traveling through the laser printer and increase the distance between media sheets. Reducing the velocity of the media allows the temperature of the coated tube to be reduced. The reduced temperature produces less heat in the overheating regions. The distance between sheets is increased so that, with the reduced media velocity, the time between media sheets becomes large enough for the small heat conduction to cool the overheating regions and prevent overheating. As the media widths become smaller, the amount of time needed to cool the overheating fuser nip regions becomes larger because the size of such regions becomes larger. The overall result of increasing sheet spacing between narrow media is that narrow width media is printed very slowly. For example, existing laser printers may reduce printing speeds for some media sheets of a print job more than 50%.

Accordingly, it will be appreciated that an efficient belt fuser with enhanced heating performance is desired.

SUMMARY

Example embodiments of the present disclosure overcome at least some of the shortcomings in prior fuser heaters and thereby satisfy a significant need for a fuser heater for effectively controlling heat within the fuser. According to an example embodiment, there is shown a heating member for a fuser of an electrophotographic imaging device, including a panel of positive thermal coefficient (PTC) material having a first surface and a second surface; and first and second conductor members. The PTC material exhibits a first electrical resistance within a predetermined range of operating temperatures and a near exponential increase in resistance at temperatures greater than the predetermined temperature range. The first conductor member is electrically coupled to the first surface of the panel of PTC material and the second conductive member is electrically coupled the second surface thereof so that the first and second conductive members support a voltage differential to be placed across the panel of PTC material. Application of an AC voltage between the first and second conductive members results in the PTC material having a temperature falling within the predetermined temperature range.

When used in an electrophotographic device, the fuser heating member provides the temperature falling within the predetermined temperature range so that the electrical resistance of the PTC material is at about the first electrical resistance. Passing media sheets through the fuser that are substantially narrower than the fuser nip width causes the portion of the fuser nip region which does not contact the sheets to increase in temperature. If such temperature increase is sufficiently beyond the predetermined temperature range, the electrical resistance of the PTC material increases substantially exponentially within the portion of the fuser nip region which does not contact the media sheets. This increase in electrical resistance within the portion of the fuser nip region not contacting the media sheets results in the temperature of the PTC material corresponding to such portion of the fuser nip region to decrease. This temperature decrease of the PTC material corresponding to the portion of the fuser nip region not contacting the media sheets serves to stabilize the material at around a temperature level greater than the temperature of the fuser nip region that contacts the media sheets but less than a temperature which may adversely affect the performance or longevity of the fuser components.

BRIEF DESCRIPTION OF THE DRAWINGS

The above-mentioned and other features and advantages of the various embodiments, and the manner of attaining them, will become more apparent and will be better understood by reference to the accompanying drawings, wherein.

DETAILED DESCRIPTION

Figure 1:
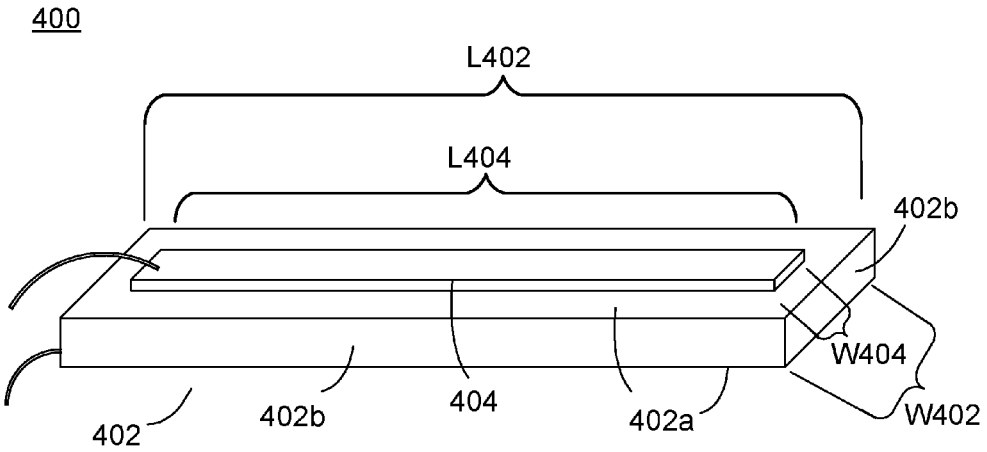
FIG. 1 is a perspective view of a heating element for an electrophotographic imaging device according to an example embodiment.

The following description and drawings illustrate embodiments sufficiently to enable those skilled in the art to practice it. It is to be understood that the subject matter of this application is not limited to the details of construction and the arrangement of components set forth in the following description or illustrated in the drawings. The subject matter is capable of other embodiments and of being practiced or of being carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense, and the scope of the present application as defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 2:
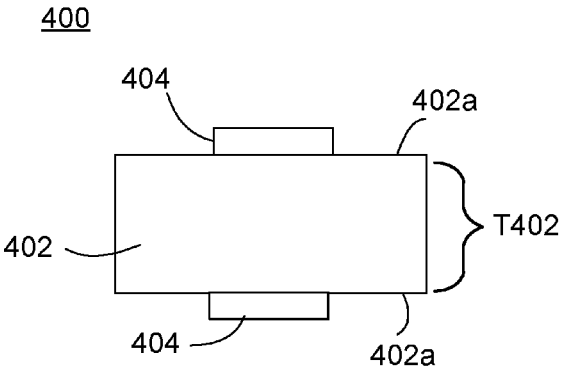
FIG. 2 is a side view of the heating element of FIG. 1 according to an example embodiment.
Figure 3:
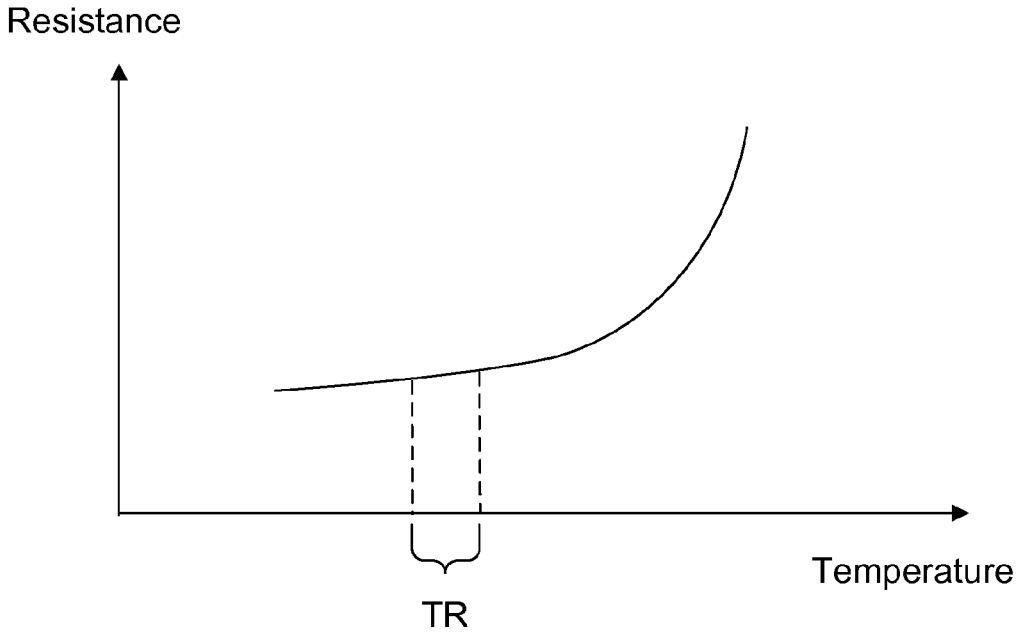
FIG. 3 is a plot showing the relationship between electrical resistance and temperature of a component of the heating device of FIG. 1.

FIGS. 1 and 2 illustrate a heating element 400 for a fuser assembly of an electrophotographic device according to an example embodiment of the present disclosure. Heating element 400 may include a panel member 402 to which electrodes 404 are attached. Accordingly to the example embodiment, panel member 402 is formed from a PTC material such that within a predetermined temperature range, the electrical resistivity of panel member 402 varies very little and is otherwise substantially constant. However, at temperatures above the predetermined temperature range, the electrical resistivity of panel member 402 rises markedly. FIG. 3 shows an approximate relationship between the electrical resistivity of panel member 402 to temperature, with the reference TR denoting the above-mentioned predetermined temperature range. The predetermined temperature range TR may be the operating temperatures of the fuser assembly at which toner is fused to media. For example, the predetermined temperature PT may be between about 220 degrees F. and about 230 degrees F.

Panel member 402 may be, for example, shaped as a rectangular prism having substantially the same rectangular cross section along its length L402. As shown in FIGS. 1 and 2, panel member 402 may have two opposed major surfaces 402*a* and four sides 402*b*. In the example embodiment, panel member 402 may have a length L402 between about 250 mm and about 280 mm, and in an example embodiment is between about 260 mm and about 270 mm. A width W402 of panel member 402 may be between about 5 mm and about 25 mm, and in an example embodiment may be between about 7 mm and 18 mm. A thickness T402 of panel member 402 may be between about 0.5 mm and about 2.0 mm, and in an example embodiment may be between about 1 mm and about 1.5 mm. The PTC material of panel member 402 may have a Perovskite ceramic crystalline structure. In an example embodiment, the PTC material may be a barium titanate ($BaTiO_3$) composition. Barium titanate compositions have been used in the production of piezoelectric transducers, multilayer capacitors and PTC thermistors due to their ferroelectric behavior that exhibits spontaneous polarization at temperatures below a corresponding Curie temperature (approximately 120° C.). Pure barium titanate ceramic is an insulator but can be made a semiconductor by controlled doping. The barium titanate composition of the PTC material of panel member 402 may be doped with strontium (Sr) and/or lead (Pb), wherein strontium is used to lower the Curie point of the material and lead is used to increase the Curie point. Doping the barium titanate composition in this manner changes grain boundary conditions such that above the Curie point, the resistance increases substantially in the PTC material. The effect of such doping is known as the positive temperature coefficient of resistivity (PTCR) effect. For the PTC material of panel member 402, lead doping percentages may be between about 12 and about 20 percent, yielding a Curie point between about 180° C. and about 220° C.

Conventional ceramic fabrication processes may be utilized to produce the doped barium titanate composition of panel member 402. Example processes may include tape casting, roll compaction, slip casting, dry pressing and injection molding. Though the selection of a particular process may be based upon a number of factors, tape casting is believed to include economic benefits over some other processes for the production of fuser heating elements for electrophotographic imaging devices.

Each electrode 404 may be mechanically, thermally and electrically coupled to a distinct major surface 402*a*. For example, electrodes 404 may be attached to panel member 402 using a ceramic glass cement or other adhesive. A width W404 and length L404 of electrode 404 may be sized to extend substantially along the fuser nip region in a paper feed direction and a direction substantially orthogonal thereto, respectively. In one example embodiment, the length L404 of electrode 404 may be between about 200 and about 230 mm, and in an example embodiment may be between about 208 mm and about 222 mm. Width W404 of each electrode 404 may be between about 5 mm to about 20 mm, and in one example embodiment may be between about 6.5 mm to about 15 mm. Each electrode 404 may be coupled to at least one wire or the like for providing a voltage across panel member 402.

Figure 4:
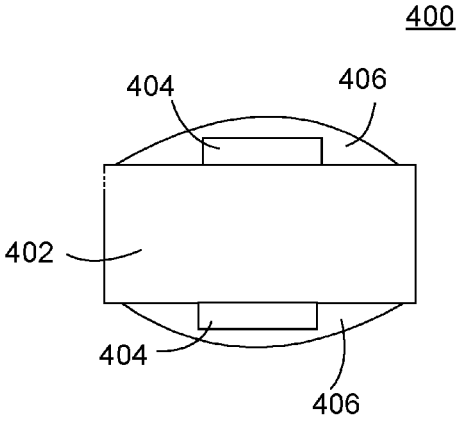
FIG. 4 is a side view of the heating element of FIG. 1 according to another example embodiment.

As shown in FIG. 4, heating element 400 may further include a protective coating 406, such as a glass insulative coating, which covers substantially all of panel member 402 and electrodes 404.

Figure 5:
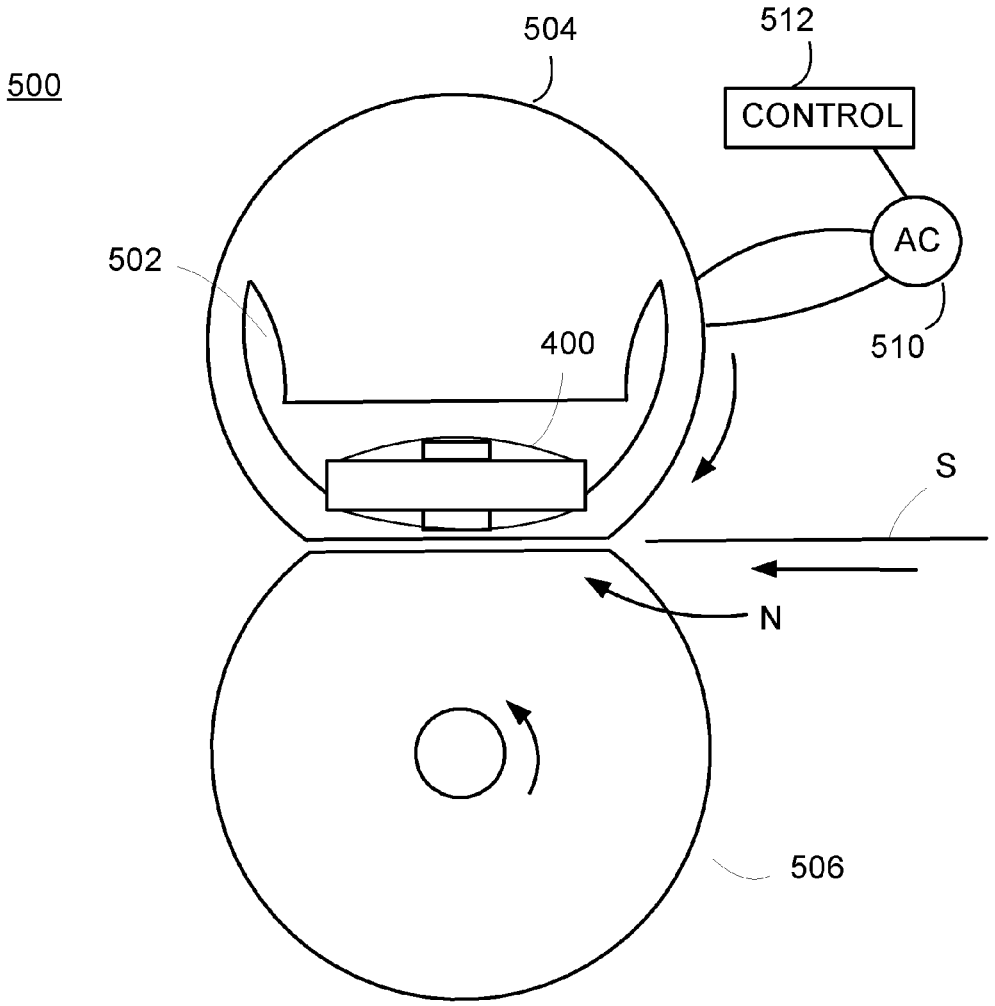
FIG. 5 is a side view of a fuser assembly incorporating the heating element of FIG. 1.

FIG. 5 illustrates a cross elevational view of a portion of a fuser assembly 500 according to an example embodiment of the present disclosure. Fuser assembly 500 may include heating element 400, a heater housing 502 which maintains heating element 400 in a substantially fixed position within fuser assembly 500, tubular belt 504 which is disposed around heater housing 502, and backup roll 506 which is positioned relative to and provides pressure against belt 504, heater housing 502 and heating element 400 so as to form a fuser nip N therewith. Heating element 400 may be disposed within fuser assembly 500 such that a major surface 402*a* is immediately adjacent to and/or contacts the inner surface of belt 504 so that heating element 400 provides sufficient heat at fuser nip N to facilitate toner fusing to a sheet of media S as the sheet is passed through fuser nip N.

Because heater housings, tubular belts and backup rollers of fuser assemblies are well known, such components will not be discussed in detail herein for reasons of simplicity.

Conductors 404 of heating element 400 may be coupled, either directly or indirectly, to an AC power source 510 which may be controlled by a controller 512. In this way, an AC voltage, such as a 120 v or 240 v, may be applied across panel member 402.

The operation of fuser assembly 500 will now be described. During a fusing operation, backup roll 506 rotates about its axis, which causes belt 504 to rotate due to contact with backup roll 506. An AC voltage from AC power source 510 is applied across panel member 402, which causes a certain current to flow between conductors 404 and heat to be generated by panel 402 as a result. The voltage across panel member 402 may fall within temperature range TR having little variation in electrical resistivity.

Figure 6:
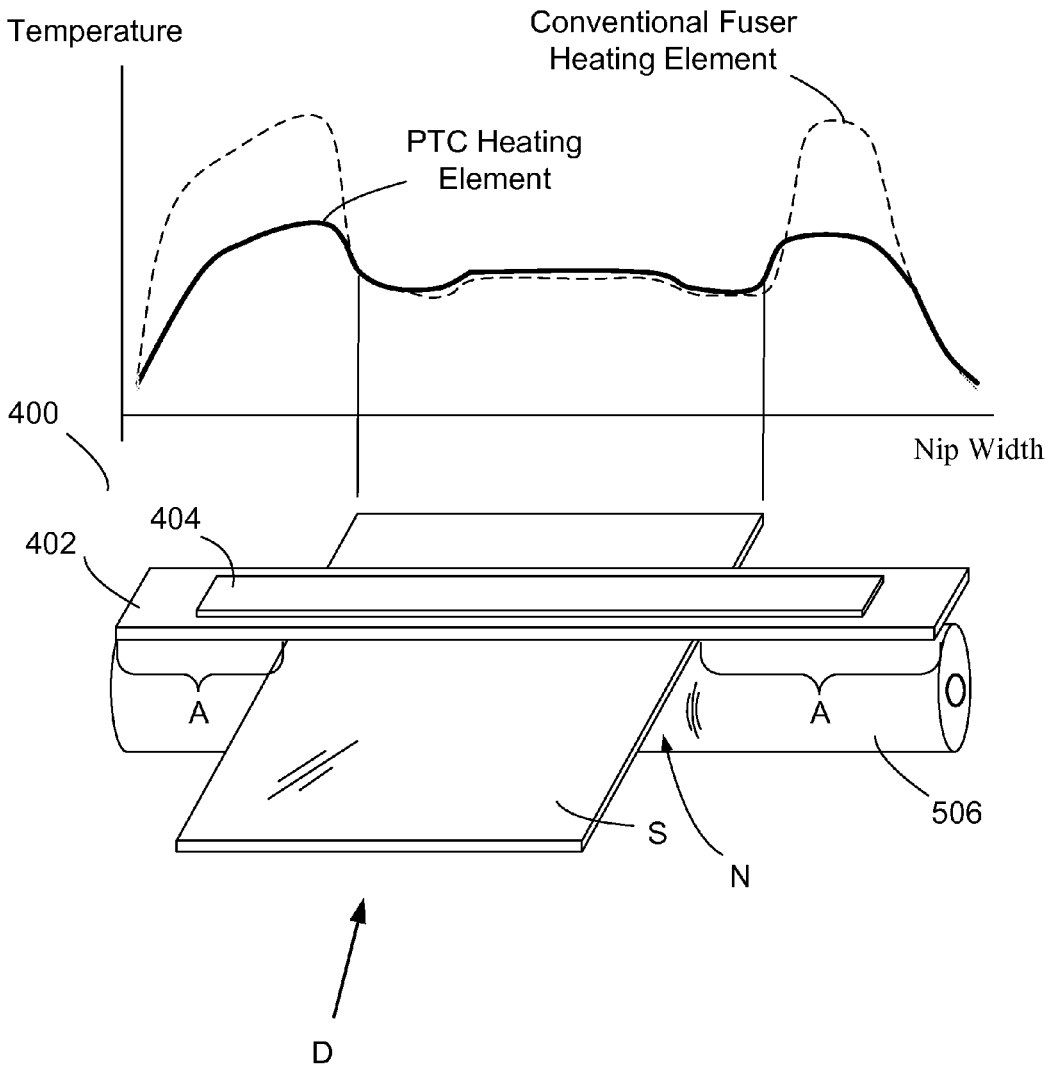
FIG. 6 is a perspective view of components of the fuser assembly of FIG. 5 together with a corresponding plot of temperature.

Referring to FIG. 6, sheets of media S having unfused toner particles are passed through fuser nip N in direction D. Media sheets S have a narrow width, noticeably narrower than the length L404 of electrodes 404. Because of the narrower sheet width, the regions A of belt 504 and backup roll 506 which do not contact media sheets S increase in temperature due to the absence of sheets to dissipate heat. However, because panel member 402 is formed from PTC material, any temperature increase of panel member 402 in portions corresponding to regions A results in an increase in electrical resistance of such portions. This may be seen in the graph of FIG. 3 in which the temperature of the portions of panel member 402 corresponding to regions A increase above temperature range TR and falls within the resistance-temperature curve that shows a more exponential relationship between electrical resistance and temperature. The increase in electrical resistance reduces the current passing through panel member 402 in the portions corresponding to regions A, which thereby results in such portions of panel member 402 to decrease in temperature. The result is that the PTC material of panel member 402 performs self-regulation and allows for heater element 400 to reach a steady state temperature within those portions of panel member 402 that are part of the fuser nip region failing to contact the media sheets S, with the steady state temperature being above the predetermined temperature range TR but less than a temperature that has been seen to cause significant damage to belt 504 and backup roll 506 over the useful life of fuser assembly 500.

FIG. 6 further shows a resulting temperature along fuser nip N relative to the temperature measured across a fuser nip of a conventional fuser assembly. As can be seen, the self-regulating characteristic of heating element 400, due to use of PTC panel member 402, results in markedly reduced temperatures along regions A of belt 504 and backup roll 506 which do not contact media sheets S. Temperatures in regions A have been seen to be about 20 degrees C. to about 50 degrees C. below temperatures in existing fuser assemblies.

Figure 7:
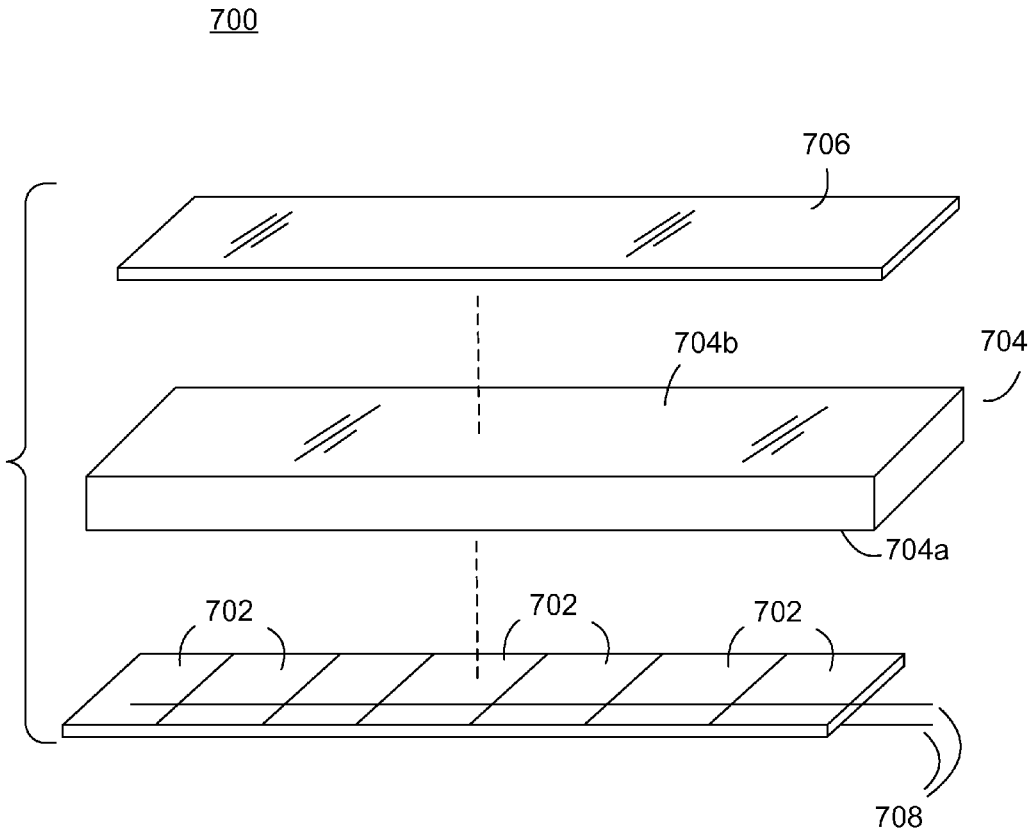
FIG. 7 is a perspective view of a heating element for an electrophotographic imaging device according to another example embodiment.

FIG. 7 shows a heating element 700 according to another example embodiment. Heating element 700 may include a plurality of individual sections 702 of PTC material. Each section 702 may be, for example, about 4.3 cm by about 1.1 cm and have a thickness of about 0.2 cm. Heating element 700 may further include a substrate 704 having a first side 704*a* along which sections 702 of PTC material may be arranged in a side-by-side arrangement. The thickness of substrate 704 may be about 0.64 mm. Each section 702 may contact an adjacent section 702 and be attached to substrate surface 704 using a cement such as potting cement or other adhesive. It is understood that the cement or adhesive used to secure sections 702 to side 704*a* of substrate 704 may be thermally conductive. In this way, the temperature of substrate 704 may substantially follow the temperature of sections 702 of PTC material.

Further, heating element 700 may include a protective layer 706 disposed over a second side 704*b* of substrate 704, as shown in FIG. 7. Protective layer 706 may be a glass layer, for example. Heating element 700 may be held within a heater housing such that protective layer 706 is disposed adjacent and in contact with the inner surface of a tubular belt 504 of a fuser assembly and the fuser nip. Heating element 700 may further include a plurality of conductive wires or traces 708, each one of which is electrically and mechanically connected to each section 702 of PTC material. One wire 708 is disposed along a top surface of sections 702 and the other wire 708 disposed along a bottom or opposed surface thereof. Wires 708 may be coupled to sections 702 of PTC material by spot welding or other methods. Wires 708 may be coupled to an AC voltage source, such as AC source 510, so that an AC voltage may be applied across each section 702. In this way, application of an AC voltage across sections 702 of PTC material creates a current through and a temperature to develop across sections 702.

Operation of a fuser assembly having heating element 700 follows the operation of fuser assembly 500 described above. An AC voltage applied across sections 702 creates a temperature falling within a predetermined operating range, such as temperature range TR, for the fuser assembly. When narrower media sheets S are passed through the fuser assembly, regions of the fuser belt and corresponding backup roller increase in temperature, which increases the temperature of sections 702 adjacent thereto. The increase in temperature of such sections 702 above the predetermined temperature range TR and into the portion of the electrical resistance-temperature curve corresponding to an approximately exponential relationship, results in an increase in the electrical resistivity of sections 702 having increased temperatures. The increase in resistivity causes the amount of current through and hence the temperature of such sections 702 to decrease, thereby serving to stabilize the temperature of the sections 702 at a steady state temperature value that is less than a temperature that would otherwise be experienced. As a result of experiencing reduced temperatures, the belt and backup roller will not substantially overheat and become damaged.

Figure 8:
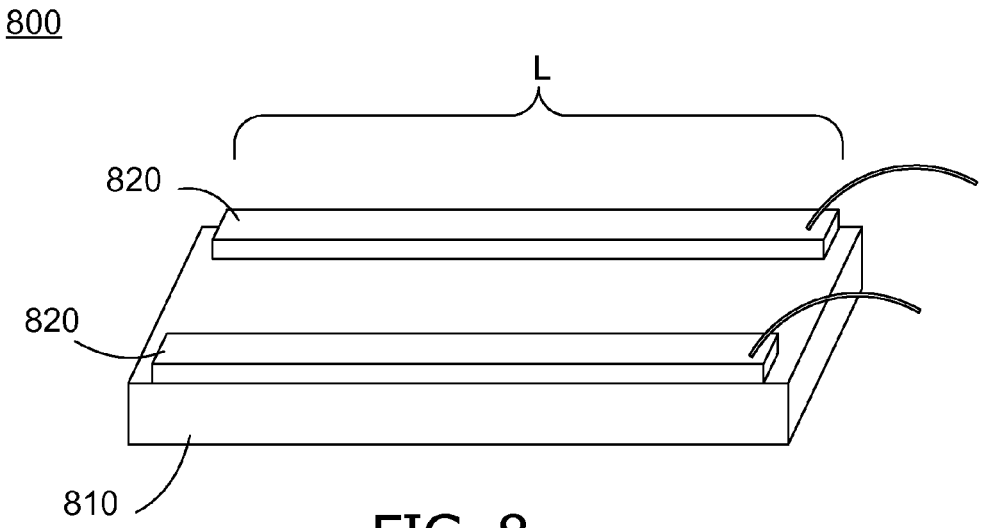
FIG. 8 is a perspective view of a heating element for an electrophotographic imaging device according to another example embodiment.
Figure 9:
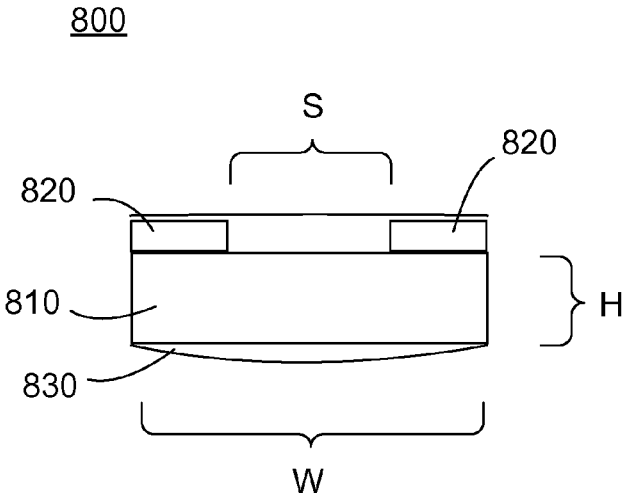
FIG. 9 is a side view of the heating element of FIG. 8.

FIGS. 8 and 9 illustrate a heating element 800 according to another example embodiment. Heating element 800 may include a panel member 810 constructed from PTC material having the characteristics and general shape as described above with respect to panel member 402. Panel member 810 may extend across fuser nip N. A width W of panel member 810 may be between about 9 mm and about 24 mm, and in particular between about 10.5 mm and about 19 mm. A height H of panel member 810 may be between about 0.5 mm to about 4 mm, and in particular between about 1 mm and about 3 mm.

Heating element 800 may further include electrodes 820 which extend along length L of panel member 810. As shown in FIGS. 8 and 9, electrodes 820 are disposed on the same surface of panel member 810 at opposite longitudinal sides thereof. Electrodes 820 may have a spacing S from each other that is between about 5 mm and about 20 mm, and in particular about 6.5 mm to about 15 mm. Each electrode 820 is mechanically, thermally and electrically coupled to panel member 810 along length L. Each electrode 820 may be between about 200 mm to about 230 mm in length, and in particular between about 208 mm to about 222 mm. Wires are connected to electrodes 820 to facilitate application of an AC signal thereto. Application of an AC signal across electrodes 820 causes a current to flow between the electrodes through panel member 810, which causes panel member 810 to become heated. An insulator layer 830 is disposed along the surface of panel member 810 opposite the surface against which electrodes 820 are attached. This surface, the surface that is opposite the surface against which electrodes 820 are attached, is disposed adjacent tubular belt 504 at fuser nip N in the fuser assembly.

Figure 10:
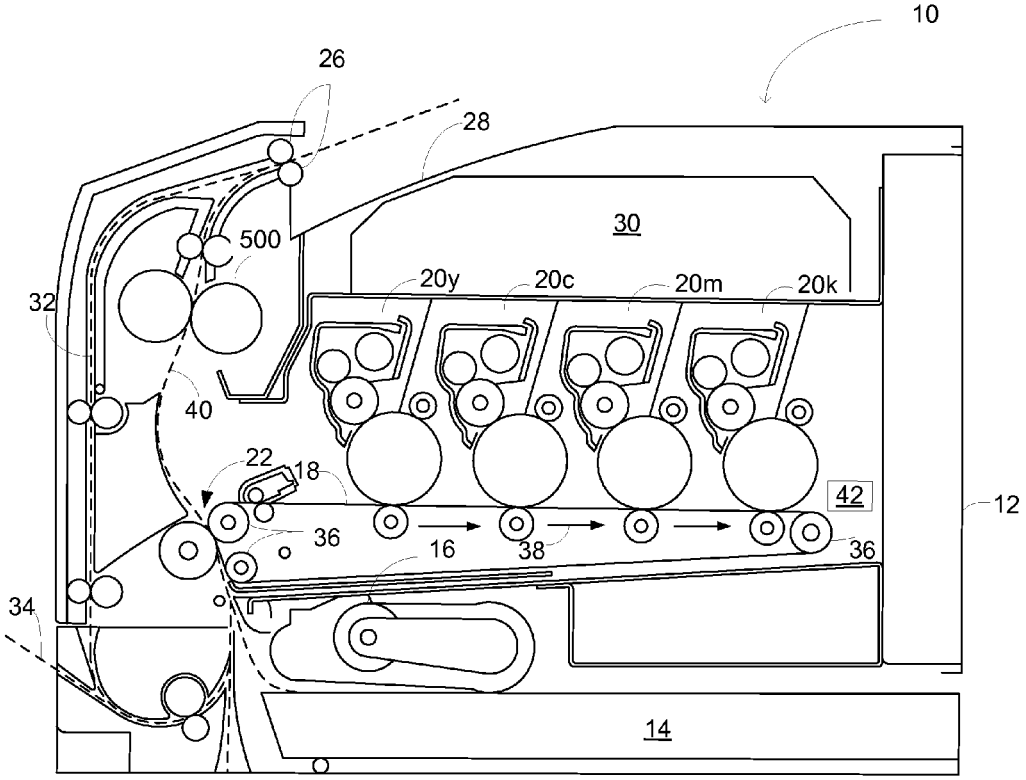
FIG. 10 is a side elevational view of an imaging device having a fuser assembly incorporating heating elements of the example embodiments.

FIG. 10 depicts an electrophotographic imaging device 10 having a fuser assembly incorporating the heating elements of the example embodiments described above. Imaging device 10 may include a main body 12, a media tray 14, a pick mechanism 16, an intermediate transfer member 18, a plurality of image forming units 20*y*, 20*c*, 20*m*, and 20*k*, a second transfer area 22, a fuser assembly 500, exit rollers 26, an output tray 28, a print head 30, and a duplex path 32. An auxiliary feed 34 allows a user to manually feed print media into the image forming apparatus 10.

The intermediate transfer member 18 is formed as an endless transfer belt supported about a plurality of support rollers 36. During image forming operations, transfer member 18 moves in the direction of arrow 38 past the plurality of image forming stations 20*y*, 20*c*, 20*m*, and 20*k* for printing with yellow, cyan, magenta, and black toner, respectively. Each image forming stations 20*y*, 20*c*, 20*m*, and 20*k* applies a portion of an image on the transfer member 18. The moving transfer member 18 conveys the image to a print media at the second transfer area 22.

The media tray 14 is positioned in a lower portion of the main body 12 and contains a stack of media. The media tray 14 is removable for refilling. Pick mechanism 16 picks print media from top of the media stack in the media tray 14 and feeds the print media into a primary media path 40. The print media is moved along the primary media path 40 and receives the toner image from the transfer member 18 at the second transfer area 22.

Once the toner image is transferred, the print media is conveyed along the primary media path 40 to the fuser assembly 500, having heating elements 400 or 700. The fuser assembly 500 fuses the toner to the print media and conveys the print media towards the exit rollers 26. Exit rollers 26 either eject the print media to the output tray 28, or direct it into the duplex path 32 for printing on a second side of the print media. In the latter case, the exit rollers 26 partially eject the print media and then reverse direction to invert the print media and direct it into the duplex path 32. A series of rollers in the duplex path 32 return the inverted print media to the primary media path 40 upstream from the second transfer area 22 for printing on the second side of the media. The image forming apparatus 10 also includes a controller 42 that provides instructions to the imaging device 10 for performing imaging.

The foregoing description of multiple embodiments has been presented for purposes of illustration. It is not intended to be exhaustive or to limit the application to the precise forms disclosed, and obviously many modifications and variations are possible in light of the above teaching. It is understood that the subject matter of the present application may be practiced in ways other than as specifically set forth herein without departing from the scope and essential characteristics. It is intended that the scope of the application be defined by the claims appended hereto.

What is claimed is:

1. A fuser for an electrophotographic imaging device, comprising:

a housing;

a heater member disposed at least partly within the housing and including a panel of positive thermal coefficient (PTC) material having a first surface and a second surface, and first and second conductor members, the first conductor member being electrically coupled to the first surface and the second surface of the panel of PTC material and the second conductor member being electrically coupled to the second surface thereof, the first and second conductor members supporting a voltage differential to be placed across the panel of PTC material;

a belt rotatably positioned about and surrounding the housing; and a backup member disposed against the belt proximal to an inner surface portion thereof so as to form a fuser nip with the belt, wherein the heater member further comprises a ceramic substrate and an adhesive or cement disposed between and directly contacting a first surface of the ceramic substrate and the panel of PTC material such that the panel of PTC material is attached to the first surface of the ceramic substrate, and a protective layer disposed directly on and directly in contact with a second surface of the ceramic substrate different from and opposite the first surface thereof such that the first and second surfaces of the ceramic substrate face directions that are opposite from each other, and wherein the heater member is disposed at least partly within the housing such that the protective layer of the heater member is disposed adjacent to and contacts the inner surface portion of the belt at the fuser nip, the protective layer of the heater member only contacting the inner surface portion of the belt at the fuser nip, the second surface of the panel of PTC material and the second surface of the ceramic substrate facing a direction towards the fuser nip and backup member, and the first surface of the panel of PTC material and the first surface of the ceramic substrate facing a direction away from and in an opposite direction to the fuser nip and the backup member.

2. The fuser of claim 1, wherein the first surface of the panel of PTC material and a length of the first conductor member extend at least partly across the fuser nip, wherein the length of the first conductor member is between about 200 mm and about 230 mm.

3. The fuser of claim 2, wherein a width of the first conductor member is equal to a width of the fuser nip.

4. The fuser of claim 1, wherein a thickness of the panel of PTC material is between about 0.5 mm and about 4 mm.

5. The fuser of claim 1, wherein the panel of PTC material comprises a plurality of panel sections such that adjacent panel sections are in contact with each other.

6. The fuser of claim 5, wherein the first and second conductor members are electrically coupled to each of the plurality of panel sections of the panel of PTC material.

7. The fuser of claim 5, wherein each of the plurality of panel sections of the panel of PTC material comprises Perovskite ceramic crystalline structure.

8. The fuser of claim 1, wherein the protective layer comprises a glass layer.

9. The fuser of claim 1, wherein the panel of PTC material has a resistance such that a current passing between the first and second conductor members generates heat, and wherein an increase in temperature of a first end portion of the heater member causes an increase in electrical resistivity of a first end portion of the panel of PTC material at the first end portion of the heater member, the increase in electrical resistivity of the first end portion of the panel of PTC material causing a decrease in temperature at the first end portion of the heater member.

10. The fuser of claim 1, wherein the first conductor member does not directly contact the ceramic substrate.

11. A fuser, comprising:

a housing;

a belt rotatably positioned about the housing;

a heater member disposed at least partially within the housing such that the housing maintains the heater member in a fixed position within the belt, the heater member comprising:

a panel of positive thermal coefficient (PTC) material having a first surface and a second surface, the second surface being opposed the first surface such that the first and second surfaces face directions that are opposite from each other;

first and second conductor members, the first conductor member being disposed on the first surface of the panel of PTC material and the second conductor member being disposed on the first surface of the panel of PTC material, the first and second conductor members supporting a voltage differential to be placed across the panel of PTC material; and an insulator layer disposed directly in contact with and covering the second surface of the panel of PTC material, the insulator layer being disposed adjacent and in direct contact with an inner surface of the belt; and a backup member positioned against an outer surface of the belt proximal to the heater member so as to form a fuser nip with the belt, wherein the direction the second surface of the panel of PTC material faces comprises a direction towards the fuser nip and backup member, the direction the first surface of the panel of PTC material faces comprises a direction away from and in an opposite direction to the fuser nip and the backup member, and the insulator layer directly contacts the inner surface of the belt at the fuser nip.

12. The fuser of claim 11, wherein the heater member further comprises an adhesive or cement disposed between and directly contacting each of the first and second conductor members and the first surface of the panel of PTC material for attaching the first and second conductor members thereto.

13. The fuser of claim 12, wherein the adhesive is thermally conductive.

14. The fuser of claim 12, wherein the heater member consists of the panel of PTC material, the first and second conductor members, the insulator layer and the adhesive or cement disposed between and directly contacting the first and second conductor members and the panel of PTC material.

15. The fuser of claim 11, wherein a spacing between the first conductor member and the second conductor member is about 5 mm to about 20 mm.

16. The fuser of claim 11, wherein a spacing between the first conductor member and the second conductor member is about 6.5 mm to about 15 mm.

17. The fuser of claim 11, wherein the panel of PTC material comprises Perovskite ceramic crystalline structure.

18. A fuser assembly, comprising:

a heater member comprising:

a panel of positive thermal coefficient (PTC) material having a first surface and a second surface different from the first surface;

first and second conductor members, the first conductor member being electrically coupled to one of the first surface and the second surface of the panel of PTC material and the second conductor member being electrically coupled to the other of the one of the first surface and the second surface, the first and second conductor members supporting a voltage differential to be placed across the panel of PTC material;

a ceramic substrate having a first surface to which the first surface of the panel of PTC material is attached, wherein the first conductor member is disposed between the first surface of the panel of PTC material and the first surface of the ceramic substrate; and a protective layer disposed directly in contact with and covering a second surface of the ceramic substrate, the first and second surfaces of the ceramic substrate being opposed surfaces such that an outer surface of the protective layer faces a direction that is opposite from a direction the first surface of the ceramic substrate faces;

a housing to which the heater member is coupled;

a belt rotatably positioned to surround the housing such that the outer surface of the protective layer of the heater member is disposed adjacent and contacts an inner surface of the belt; and a backup member disposed against the belt so as to form a fuser nip with the belt, the outer surface of the protective layer of the heater member only contacting the inner surface of the belt at the fuser nip, wherein the direction the second surface of the ceramic substrate faces is towards the fuser nip and the backup member, the direction the first surface of the ceramic substrate faces is away from the fuser nip and the backup member, the first surface of the panel of PTC material faces the fuser nip and the backup member, and the second surface of the panel of PTC material faces a direction away from the fuser nip and the backup member.

19. The fuser assembly of claim 18, wherein the outer surface of the protective layer faces a direction that is opposite from the direction of the second surface of the panel of PTC material faces.

20. The fuser assembly of claim 18, further comprising a cement or adhesive disposed between and directly contacting the first surface of the ceramic substrate and the first surface of the panel of PTC material such that the panel of PTC material is attached to the first surface of the ceramic substrate via the cement or adhesive.

21. The fuser of claim 18, wherein the protective layer comprises a glass layer.

22. The fuser of claim 18, wherein the panel of PTC material has a resistance such that a current passing between the first and second conductor members creates heat, the only heat generated by the heater member is generated by the panel of PTC material.

23. The fuser of claim 18, wherein the second conductor member does not directly contact the ceramic substrate.

* * * * *